US009163415B2

(12) United States Patent
Nies

(10) Patent No.: US 9,163,415 B2
(45) Date of Patent: Oct. 20, 2015

(54) MANTEL WITH HIDDEN MOUNTING ASSEMBLY

(71) Applicant: Joel M Nies, Greenleaf, WI (US)

(72) Inventor: Joel M Nies, Greenleaf, WI (US)

( * ) Notice: Subject to any disclaimer, the term of this patent is extended or adjusted under 35 U.S.C. 154(b) by 1 day.

(21) Appl. No.: 14/143,919

(22) Filed: Dec. 30, 2013

(65) Prior Publication Data

US 2015/0182024 A1 Jul. 2, 2015

(51) Int. Cl.

| | |
|---|---|
| ***E04F 19/00*** | (2006.01) |
| ***A47B 96/02*** | (2006.01) |
| ***A47B 96/06*** | (2006.01) |
| ***A47B 57/52*** | (2006.01) |
| *A47B 57/56* | (2006.01) |

(52) U.S. Cl.

CPC ..... *E04F 19/005* (2013.01); *A47B 57/52* (2013.01); *A47B 96/027* (2013.01); *A47B 96/028* (2013.01); *A47B 96/061* (2013.01); *A47B 96/066* (2013.01); *A47B 57/56* (2013.01)

(58) Field of Classification Search

CPC .. A47B 96/066; A47B 96/022; A47B 96/061; A47B 57/565; A47B 96/00; A47B 57/52; A47B 57/42; A47B 57/56; A47B 57/567; A47B 57/46; A47B 57/045; A47B 96/028; A47B 96/067; A47B 5/02; A47B 96/027; A47B 5/0846; A47B 96/021; A47B 96/02; E04F 19/005; F16B 12/14; E04B 2002/7483

USPC ..... 52/36.3, 211, 717.01, 717.04, 717.05, 52/716.01; 108/152, 108, 42, 147.11, 108/147.17; 248/250, 235, 217.2, 225.11; 126/500; D23/404

See application file for complete search history.

(56) References Cited

U.S. PATENT DOCUMENTS

| | | | |
|---|---|---|---|
| 365,690 | A | 6/1887 | Kochsmeier |
| 716,852 | A | 12/1902 | Baker |
| 1,354,270 | A | 9/1920 | Wood |
| 1,504,523 | A | 8/1924 | Sherer |
| 1,778,075 | A | 10/1930 | Frances |
| 2,036,884 | A | 4/1936 | Reeves |
| 2,244,978 | A | 6/1941 | Tinnerman |
| 2,271,469 | A | 1/1942 | Wilson |
| 3,029,056 | A | 4/1962 | Breglia |

(Continued)

FOREIGN PATENT DOCUMENTS

| | | | | |
|---|---|---|---|---|
| GB | 2109672 | A * | 6/1983 | ..... A47B 96/06 |
| GB | 2214414 | A * | 9/1989 | ..... A47B 96/06 |

(Continued)

*Primary Examiner* — Joshua J Michener
*Assistant Examiner* — Matthew Gitlin
(74) *Attorney, Agent, or Firm* — Jeffrey S. Sokol; Sokol Law Office

(57) ABSTRACT

The invention is a mantel or shelf made of a solid block of reclaimed wood with a hidden mounting assembly. The mantel has sufficient thickness, depth and length to accommodate an elongated L-shaped sheet metal bracket with planar horizontal and vertical flanges to allow selective lateral positioning of the mantel relative to its securement to spaced vertical wall studs. An L-shaped opening in the rear of the mantel is formed by a deep horizontal slot and a shallow vertical recess extending down from the slot. The slot is parallel to and near the top of the mantel, and receives the horizontal flange. The recess receives the vertical flange so the mantel is flush with the wall. A mounting fastener inserted into the mantel pierces the horizontal flange to capture the bracket and secure the mantel to the wall. The bracket, slot and recess are hidden from view during use.

21 Claims, 11 Drawing Sheets

(56) References Cited

U.S. PATENT DOCUMENTS

| | | | | | |
|---|---|---|---|---|---|
| 3,166,285 | A | | 1/1965 | Downes | |
| 3,295,474 | A | | 1/1967 | Ornstein | |
| 3,311,435 | A | | 3/1967 | Heritage | |
| 3,333,555 | A | | 8/1967 | Kapnek | |
| 3,363,867 | A | * | 1/1968 | Zackrisson | 248/250 |
| 3,381,636 | A | | 5/1968 | Saiberlich | |
| 3,432,134 | A | | 3/1969 | Forschmidt | |
| 3,469,869 | A | * | 9/1969 | Ramakers | 403/264 |
| 3,527,175 | A | | 9/1970 | Kapnek | |
| 3,614,044 | A | | 10/1971 | Bard | |
| 3,669,395 | A | | 6/1972 | Gehrke | |
| 3,714,907 | A | * | 2/1973 | Michieli | 108/152 |
| 3,730,477 | A | | 5/1973 | Wavrunck | |
| 3,752,088 | A | | 8/1973 | Kapnek | |
| 3,834,659 | A | | 9/1974 | Siegal | |
| 3,837,605 | A | | 9/1974 | Sicard | |
| 3,849,950 | A | | 11/1974 | Albinson et al. | |
| 3,865,336 | A | | 2/1975 | Robertson | |
| 3,945,595 | A | | 3/1976 | Schlueter | |
| 3,981,118 | A | | 9/1976 | Johnson et al. | |
| 4,012,880 | A | * | 3/1977 | Logie | 52/584.1 |
| 4,036,559 | A | * | 7/1977 | Whitchurch | 403/361 |
| 4,426,057 | A | | 1/1984 | Nudo | |
| 4,441,433 | A | * | 4/1984 | Caldwell | 108/152 |
| 4,639,161 | A | * | 1/1987 | Mazaki | 403/245 |
| 4,871,136 | A | | 10/1989 | Bessinger et al. | |
| 5,097,771 | A | | 3/1992 | James, III | |
| 5,135,194 | A | | 8/1992 | Barret et al. | |
| 5,197,703 | A | * | 3/1993 | Pratolongo | 248/225.11 |
| 5,326,061 | A | | 7/1994 | Hamilton | |
| 5,351,842 | A | | 10/1994 | Remmers | |
| 5,788,200 | A | | 8/1998 | Jones | |
| 5,799,803 | A | | 9/1998 | Muller | |
| 5,954,306 | A | | 9/1999 | Hoover | |
| 6,065,724 | A | | 5/2000 | Arslan et al. | |
| 6,164,610 | A | * | 12/2000 | Santiago | 248/235 |
| 6,357,608 | B1 | * | 3/2002 | Timm | 211/90.01 |
| 6,364,263 | B1 | | 4/2002 | Ryan | |
| 6,478,518 | B1 | * | 11/2002 | Hwang | 411/104 |
| 6,663,201 | B2 | | 12/2003 | Herron et al. | |
| 6,986,488 | B2 | * | 1/2006 | Migli | 248/250 |
| 7,207,536 | B2 | | 4/2007 | Conway et al. | |
| 7,360,627 | B2 | * | 4/2008 | Scott | 182/82 |
| 7,578,633 | B2 | | 8/2009 | Walz | |
| 7,708,252 | B2 | * | 5/2010 | Vander Berg et al. | 248/544 |
| 7,793,450 | B2 | | 9/2010 | Chasmer et al. | |
| 7,954,653 | B2 | | 6/2011 | Adams et al. | |
| 8,082,859 | B2 | * | 12/2011 | Sevack | 108/152 |
| 2005/0237732 | A1 | * | 10/2005 | Lagman et al. | 362/132 |
| 2007/0125738 | A1 | * | 6/2007 | Sevack | 211/187 |
| 2008/0224004 | A1 | * | 9/2008 | Gallien | 248/220.1 |
| 2009/0205263 | A1 | * | 8/2009 | Heath et al. | 52/36.3 |
| 2009/0224119 | A1 | * | 9/2009 | Heffernan | 248/225.11 |
| 2011/0315647 | A1 | * | 12/2011 | Andersson | 211/90.01 |

FOREIGN PATENT DOCUMENTS

| | | | | | |
|---|---|---|---|---|---|
| GB | 2232345 | A | * | 12/1990 | A47B 96/06 |
| GB | 2214414 | B | * | 8/1991 | |
| GB | 2232345 | B | * | 9/1992 | |
| WO | WO 9524844 | A1 | * | 9/1995 | |
| WO | WO 2006119571 | A1 | * | 11/2006 | |
| WO | WO 2010043567 | A1 | * | 4/2010 | A47B 96/06 |

* cited by examiner 5
6
8
6
20
50
70
91
71
30
91
31
32
34
9

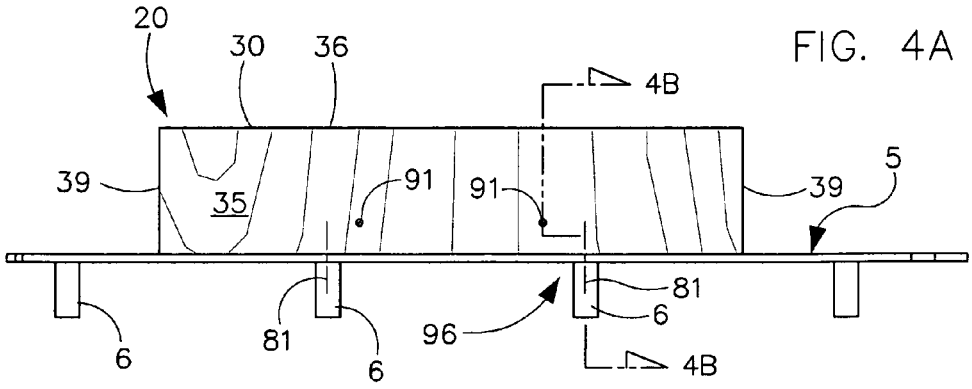
FIG. 4A
FIG. 4B
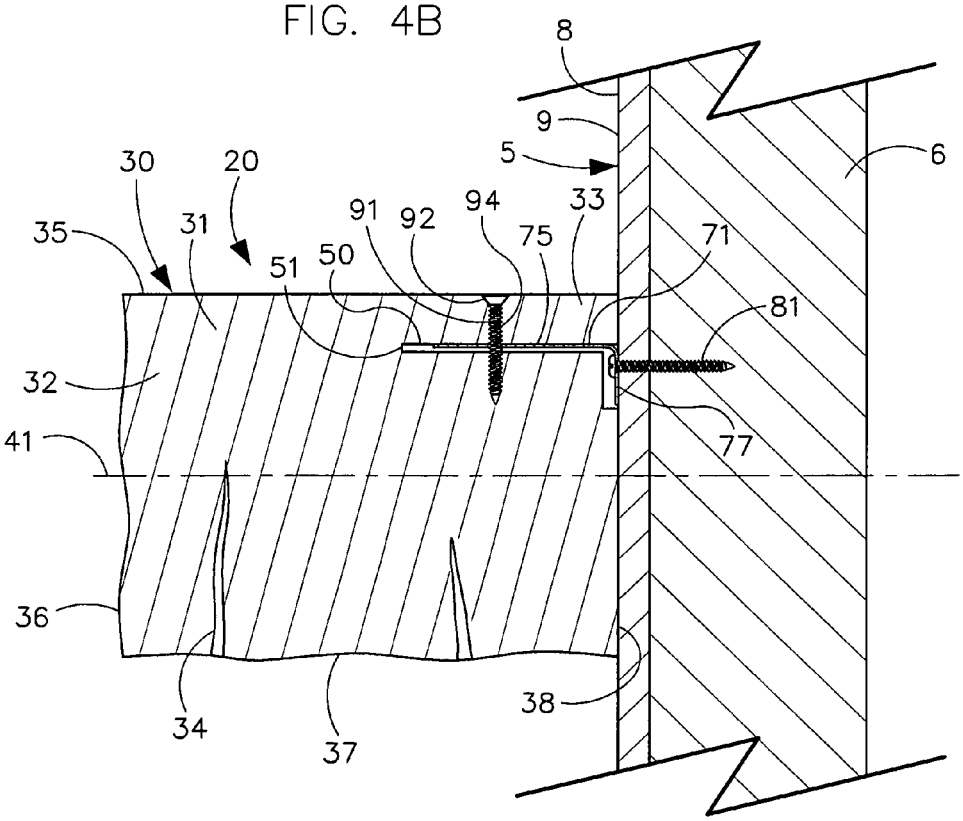

FIG. 6A
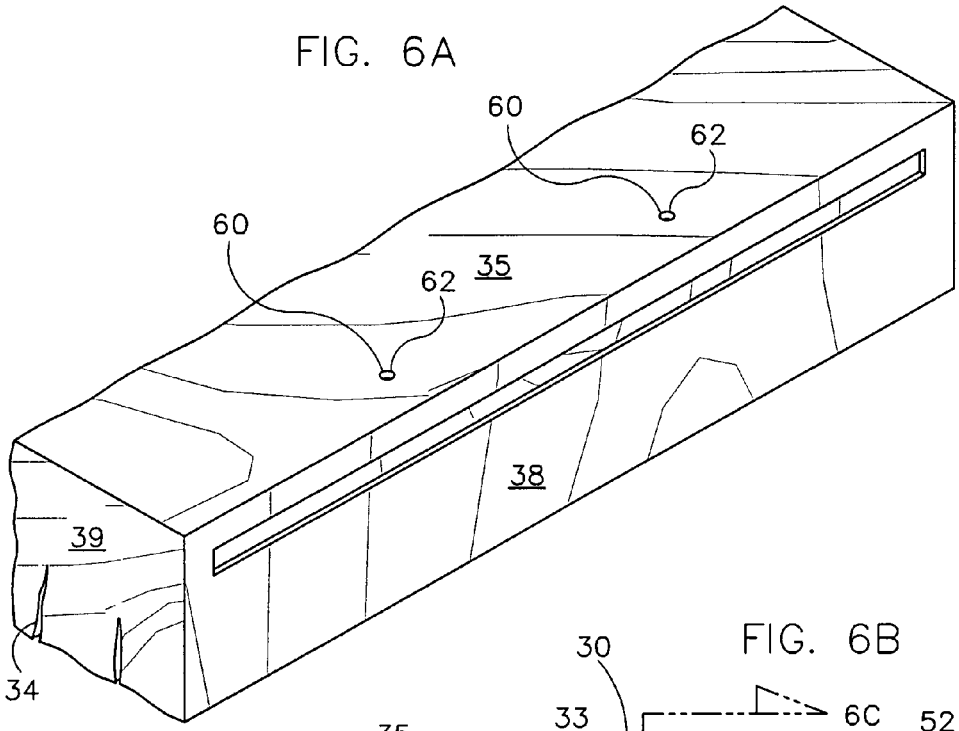
FIG. 6B
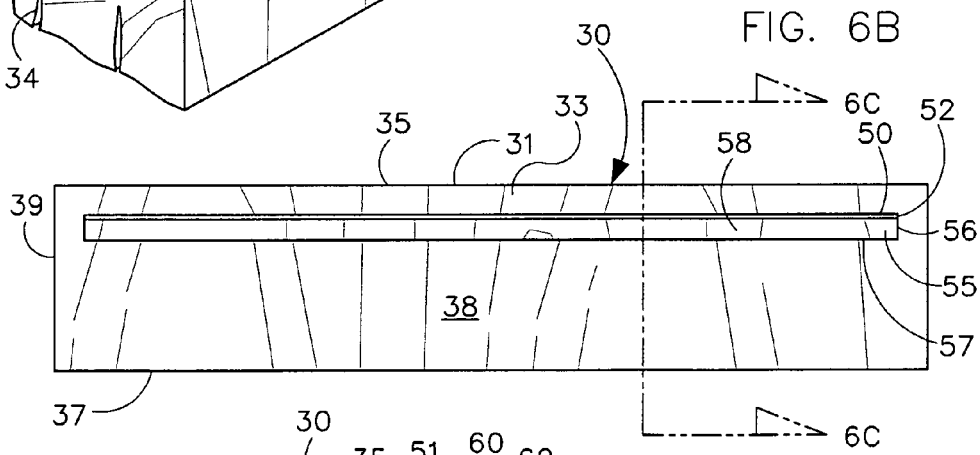
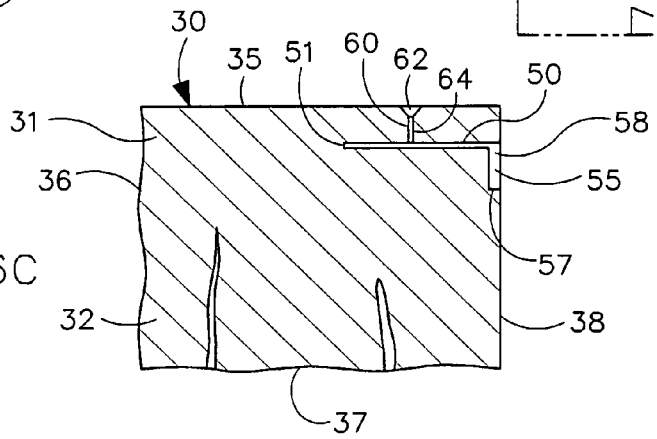
FIG. 6C

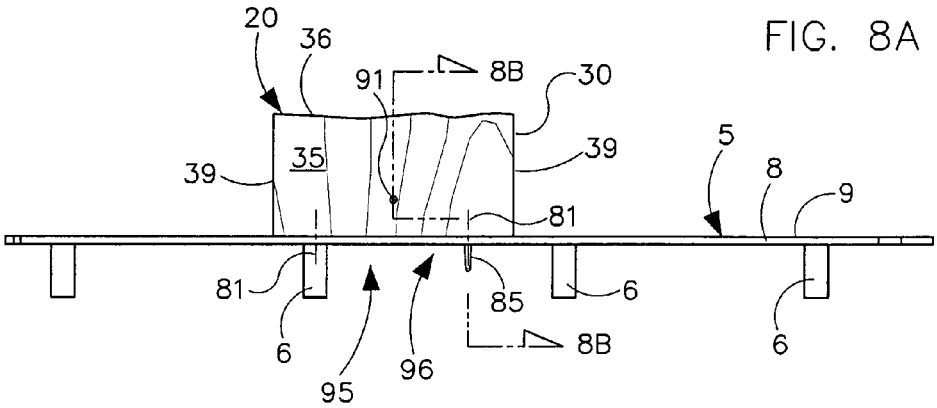
FIG. 8A
FIG. 8B
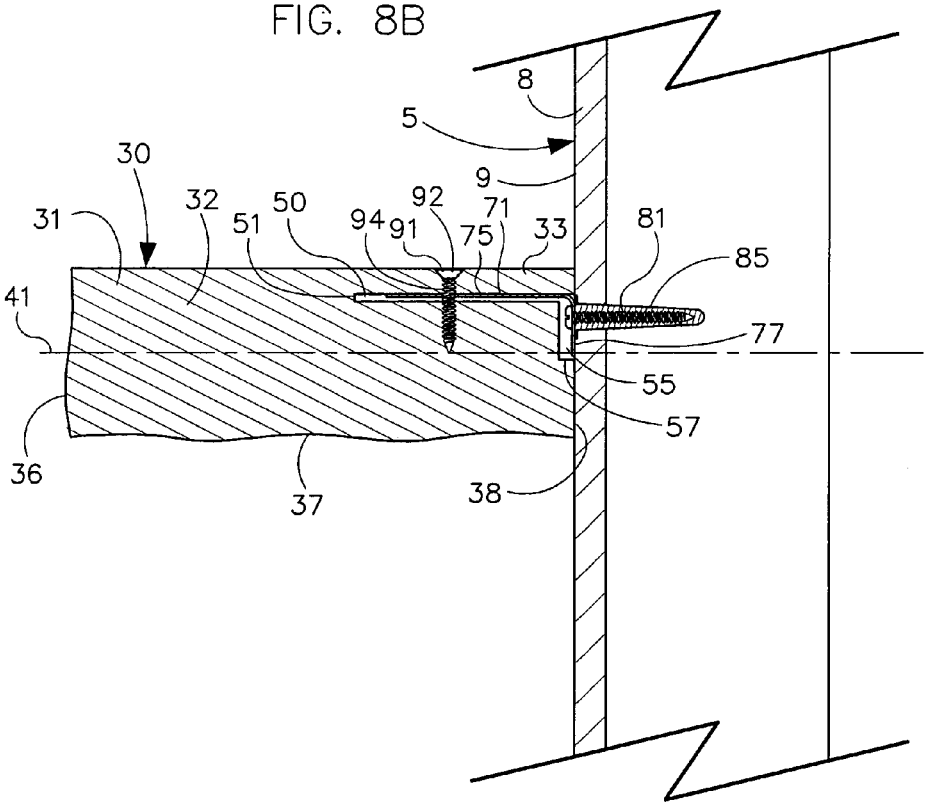

MANTEL WITH HIDDEN MOUNTING ASSEMBLY

TECHNICAL FIELD OF THE INVENTION

This invention pertains to a mantel or shelf made of a solid block of reclaimed wood of sufficient thickness, depth and length to receive, hide and work with its mounting hardware to support objects, where the hardware includes an elongated bracket with a vertical flange secured to the wall studs, and a horizontal flange received by an elongated slot in the mantel, and with a mounting fastener to pierce the captured flange to secure the mantel to the bracket and wall.

BACKGROUND OF THE INVENTION

Shelving for residential and commercial applications is commonly used to display or store a wide variety of articles to reduce clutter or improve the physical or visible access to the articles. Some articles are relatively compact or light in weight, such as pictures, antiques, family heirlooms, knick-knacks and the like. Other articles are relatively bulky or heavy in weight, such as detergent containers, boxes of soda, television sets and the like. Factors in shelving design are that the articles placed on the shelving frequently change over time and the location of the shelving is frequently in areas and at a height that brings the shelving into constant view. As a result, shelving designs typically seeks to optimize the weight carrying capacity of the shelving while providing an attractive appearance.

When shelving is provided in well traveled areas, the aesthetic value of hiding its mounting hardware is often desired. Shelving that masks or hides its mounting hardware is well known. Examples of hidden shelving hardware are the bars, rods, pins, anchors, screws and nuts that secure the shelving to the wall or its wall studs as in U.S. Pat. Nos. 3,333,555, 3,527,175 and 3,752,088 to Kapnek, the brackets and rods or cantilevered members of U.S. Pat. No. 6,164,610 to Santiago, or the hanger type hardware that engages the inner surface of the wall as in U.S. Pat. Nos. 4,441,433; 5,788,200 and 5,954,306 to Hoover, Jones and Caldwell, respectively, the disclosures of which are incorporated by reference.

One problem with conventional hidden shelving mounting hardware designs is that the predrilled rod receiving holes in the thinner shelving boards are spaced apart fixed distance, presumably to retain the weight supporting integrity of the thinner boards. Yet, the distance between adjacent vertical wall studs in a wall are not always the same. While studs are often spaced 16 inches apart, this spacing can vary and is frequently more or less than this amount. As a result, the predrilled rod receiving holes often do not align with the wall studs. Similarly, the desired location of the shelving frequently does not aligned with the wall studs. The shelving location cannot be shifted to the right or left of the wall studs to a more desirable location on the wall without one or more of the predrilled rod receiving holes missing a wall studs, which can reduce the weight carrying capacity of the shelving. While the use of wall anchors can be used when a wall stud is not present, this type of securement is generally considered less desirable for weight baring reasons than securing directly to a stud.

Another problem with conventional hidden shelving mounting hardware is that it is designed for thinner shelving boards. There is a tradeoff between the diameter of the rods and the amount of material removed from the board. The larger the diameter of the rods, the more board material that is removed and the more its weight carrying capacity is reduced.

Similarly, the smaller the diameter of the rod, the more their weight caring capacity is reduced. In addition, the predrilled holes in the boards are centrally located between the top and bottom surfaces of the board so that sufficiently thick amounts of board material remain both above and below the hole to minimize its loss of load bearing capacity.

A further problem with conventional hidden shelving mounting hardware designs is that they are intended for shelving boards made of a uniform and consistent composite material. The thinner boards are free of cracks, splits or other defects that could reduce the load caring capacity of the shelving or cause it to fail, particularly if the defect were near one of the holes for inserting a support rod. The designs are not intended or well suited for use with reclaimed wood that is frequently cracked or split, or includes knots, embedded nails or other discontinuities or imperfections.

The French cleat is a conventional type of cabinet mount that is sometimes adapted for shelving applications. The mount is formed by opposed cleats with angled mating ends. One set of cleats is anchored to the wall and a second set is secured to the back of a cabinet or item being mounted as in U.S. Pat. No. 7,954,653 to Adams. The ends of the wall cleats angle down and toward the wall to draw the cabinet and its cleats into abutting engagement with the wall. An adaptation of a French cleat for a shelving application is shown in U.S. Pat. No. 3,381,636 to Saiberlich, the disclosure of which is incorporated by reference. The shelf mount has a horizontal bar with a uniform groove along its length. The bar is secured to a wall with the groove facing up. One end of the thin shelf board has a uniform downwardly facing hook along its length. The groove and hook mate to hold the cantilevered board. The shelf board and mounting bar are both made of wood or other suitable material, and the lower surface of the mounting bar is curved to flushly engage the lower surface of the shelf board so the bar appears to be part of the shelf.

The French cleat suffers from a variety of problems for mounting a solid wood mantel, particularly one made of reclaimed wood. By their nature and for aesthetic reasons, reclaimed wood mantels have cracks, splits, knots and other discontinuities. Some surfaces are purposely left in their natural roughened condition. Any discontinuities in the vicinity of the routed groove can prevent proper alignment of the cleats, or weaken the mounting joint or cause it to fail. Additionally, while cabinets have a recessed back panel that can easily receive a cleat, a solid mantel of reclaimed wood must be intricately machined to cut an angled or squared off groove into its back surface. Forming the cleat groove requires additional manufacturing costs, such as the cost of an industrial router to cut through the hardened reclaimed wood, and frequent replacement of expensive routing tool blades due to the nails and other objects in the wood. Furthermore, consumers frequently have no special carpentry skills or training to install the mantel, and thus frequently secure the wall cleats slightly misaligned so they do not properly align with the routed groove in the back of the mantel. This causes unsightly gaps between the mantel and the wall, or shifting or jiggling of the mantel when it is bumped or items are placed on it.

The present invention is intended to solve these and other problems.

BRIEF DESCRIPTION OF THE INVENTION

The present invention pertains to a mantel made of a solid block of reclaimed wood with a hidden mounting assembly. The mantel or shelf has sufficient thickness, depth and length to accommodate the insertion of a sheet metal bracket bent into an L-shape configuration with elongated horizontal and vertical planar flanges. The vertical flange is placed flush on the surface of the wall and aligned with and secured to its spaced wall studs. A deep slot is cut into the rear surface of the mantel. The slot is parallel to the top surface of the mantel, and sized to receive the horizontal flange extending from the wall. A mounting fastener is inserted into the mantel to pierce the horizontal flange and secure it to the bracket. The rear surface of the mantel includes a shallow recess extending down from the slot to receive the vertical flange so the rear surface of the mantel is flush with the wall surface. The slot terminates short of the side ends of the mantel and the recess terminates short of its bottom surface so the bracket, slot and recess remain hidden from view during use.

One advantage of the present mantel and hidden mounting assembly is its strength. The sheet metal bracket secures the mantel to the wall studs to provide a strong connection to the wall. The bracket supports the downward force of the mantel and the objects placed on it, and retains the top of the mantel or shelf in flush engagement with the wall. The height of the mantel allows its bottom rear end to press against the drywall to resist the torque loads exerted by the outwardly extending mantel and object placed on it toward its cantilevered front end. The geometry of the mantel works together with its hardware to minimize and distribute these torque loads so that they are easily withstood by the drywall or other wall surface material. In other words, the mantel geometry helps reduce the compression load exerted by the lower end of the mantel on the drywall when an object is placed on the mantel. The mantel block has a height-to-depth ratio of at least 1 to 3 or ⅓ so that the compression force on the drywall does not crush or otherwise deform the drywall during use. The tensile strength of the sheet metal bracket keeps the top of the mantel from pulling away from the wall. For example, when the height-to-depth ration is 1 to 3 (e.g., 2" high×6" deep mantel) the assembly supports a tested load of 15 pounds when anchored into two wall studs. When the height-to-depth ration is 1 to 2 (e.g., 3" high×6" deep mantel) the assembly support a tested load of 50 pounds when anchored into the wall studs. When the height-to-depth ration is 1 to 1 (e.g., 6" high×6" deep mantel) the assembly support a tested load of 100 pounds when anchored into two wall studs.

Another advantage of the present mantel and hidden mounting assembly is its user friendly design. The linear mounting bracket is easily horizontally aligned on a wall. When the vertical flange is flush against and secured to one wall stud, a conventional level is placed on the extending horizontal flange to level the bracket. Problems with linearly aligning multiple wall mounting connections are avoided. Pre-drilled uniformly spaced holes in the vertical flange allow easy installation of the bracket to adjacent wall studs. In addition, the linear mantel slot is easily aligned with the linear horizontal bracket flange. The problems associated with aligning multiple bracket and mantel connections is avoided. The horizontal flange extends a sufficient distance from the wall so that a person can readily see both the slot and flange when they are being aligned. The user does not have to align multiple short cleats that are almost impossible to see when the mantel is brought close to the wall during installation. Also, there is little or no binding between the mantel and bracket when sliding the mantel or shelf onto the bracket and into engagement with the wall. The single L-shaped bracket smoothly mates with the single like-shaped mantel opening formed by its slot and recess. Additionally, the predrilled mounting hole avoids any confusion as to where the mounting fastener should properly engage and pierce the mounting flange. The predrilled hole also aids in the insertion of the mounting fastener. The use of a sheet metal bracket also allows the screw fastener to readily pierce the mounting flange enclosed in the slot to secure the mantel or shelf to the bracket.

A further advantage of the present mantel and hidden mounting assembly is its mounting location adaptability. When the length of the mounting bracket is greater than the 16 inch spacing between the wall studs, the bracket can be aligned in front of and secured directly to two adjacent wall studs while allowing the bracket to shift to the right or left. In other words, the elongated mounting bracket allows selective lateral positioning of the mantel or shelf on the wall relative to the wall studs, so the mantel can be mounted at a desired location. This allows the mantel or shelf to be installed in an offset alignment with respect to the wall studs. Similarly, the mounting holes and mantel fasteners can be offset alignment with the fastener securing the bracket to the wall or its wall studs. The ability to offset the alignment of the bracket and mantel from the wall studs gives the consumer the flexibility of selecting a desired location of the mantel on the wall.

A still further advantage of the present mantel and hidden mounting assembly is its flush engagement with the wall. The inwardly extending slot joins with the external recess to form an L-shaped mantel opening. The L-shaped mounting bracket is matingly received by this like shaped mantel opening. The longer mounting flange fits into the slot until the shorter wall securing flange and the heads of its fasteners are received by the recess. This structure allows the rear surface of the mantel to flushly engage the surface of the wall.

A still further advantage of the present mantel and hidden mounting assembly is manufacturing efficiency and cost savings, particularly for reclaimed wood applications. The mounting slot is easily cut with a conventional table saw with a circular blade making a single pass along the rear of the mantel or shelf. Similarly, the rear recess is easily cut with a set of conventional dado blades making a single pass along the rear of the mantel. Machine time and power consumption are kept to a minimum as the cuts are linear and amount of wood being removed is relatively minimal. Intricate aligned cuts are not required. The conventional saw and dado blades are also relatively inexpensive, replacing them due to damage caused by nails and other objects in the reclaimed wood does not significantly increase manufacturing costs. In addition, the mounting bracket is easily formed from conventional sheet metal. Its generally rectangular shape is easily cut by a conventional slitter, and the single bend in the L-shaped bracket is easily made with a conventional sheet metal brake. Expensive equipment with expensive repairs and long down times are not necessary.

A still further advantage of the present mantel with hidden mounting hardware is the availability of reclaimed wood with dimensions needed to practice the invention. Barns and other older or outdated farm buildings are commonly made of solid wood beams or posts with sufficient dimensions to fabricate the solid mantel or shelf blocks of the present invention. There is no need to join two or more pieces of reclaimed wood to fabricate the mantel blocks.

Other aspects and advantages of the invention will become apparent upon making reference to the specification, claims and drawings.

BRIEF DESCRIPTION OF THE DRAWINGS

FIG. 4A is a top view of the mantel secured to a wall via two wall studs, and showing the offset alignment of the wall securement and mantel mounting screws.

FIG. 4B is a cross sectional view of FIG. 4A taken along line 4B-4B showing the 4×4 inch height and depth of the mantel with the L-shaped mounting bracket received in the L-shaped slot and recess opening with its mounting screw passing through the captured horizontal bracket flange, and one of the securement screws fixing the vertical bracket flange to one of the wall studs to secure the mantel to the wall.

FIG. 6A is a rear perspective view of the mantel showing its rear recess and guide holes in its top surface.

FIG. 6B is a rear view of the mantel showing its slot and recess extending to just short of the side ends of the mantel.

FIG. 6C is a cross sectional view of FIG. 6B taken along line 6C-6C showing the L-shaped opening formed by the deep slot and shallow recess, and the mounting guide hole extending from its entry location in the top surface through the upper layer to the slot.

FIG. 8A is a top view of the 16 inch long shelf secured via one wall stud and one wall anchor.

FIG. 8B is a cross sectional view of FIG. 8A taken along line 8B-8B showing the 2×6 inch height and depth of the shelf with the L-shaped mounting bracket received by its L-shaped slot and recess opening with its mounting screw passing through the captured horizontal bracket flange, and a securement screw fixing the vertical flange to the wall anchor.

DESCRIPTION OF THE PREFERRED EMBODIMENTS

Figure 1:
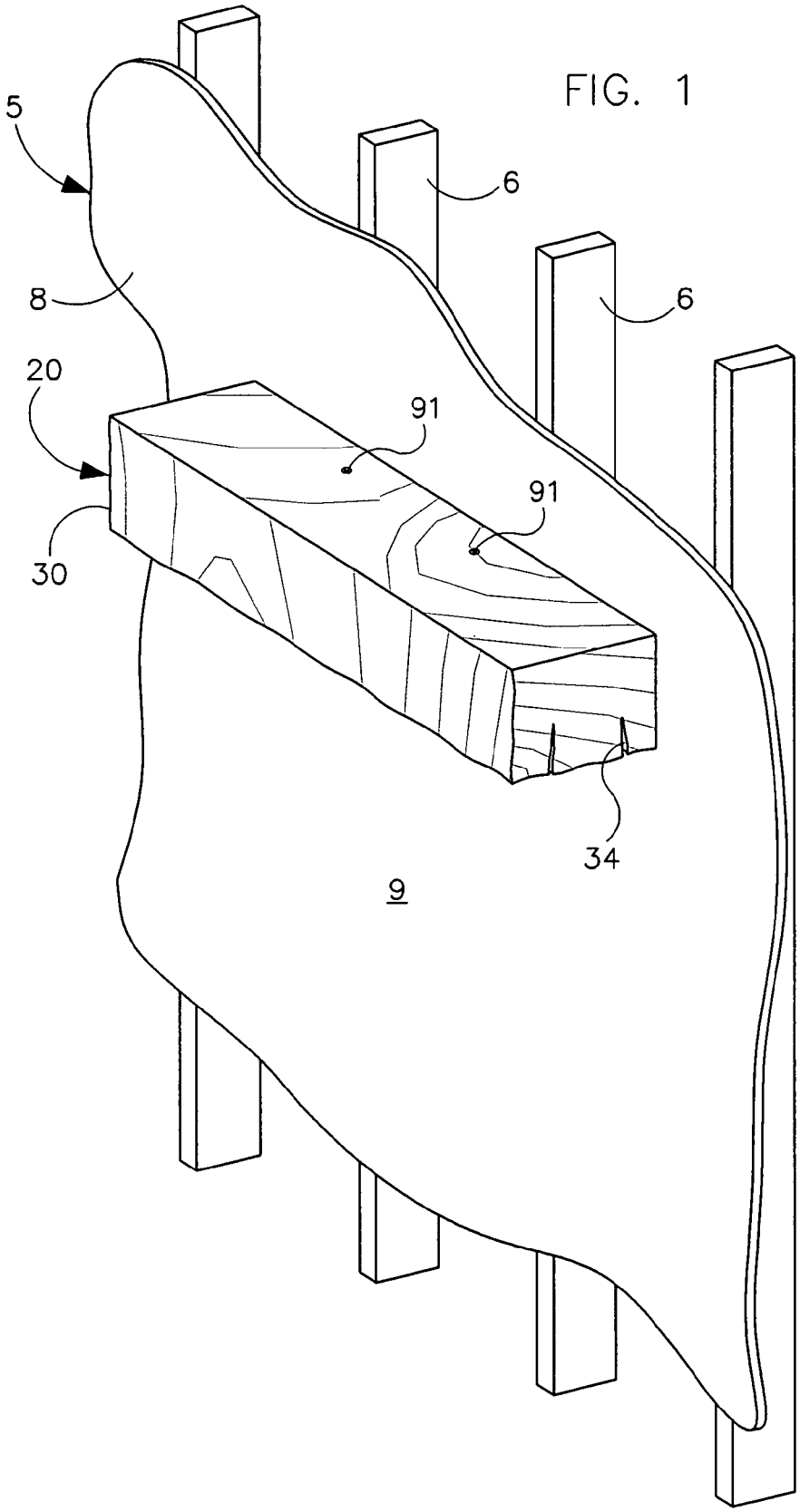
FIG. 1 is a perspective view of the mantel with hidden mounting hardware invention showing a 34 inch long mantel with a 4×4 inch cross section and two mounting holes, and with the wall surface material cut away to show the vertical wall studs of the wall.
Figure 2:
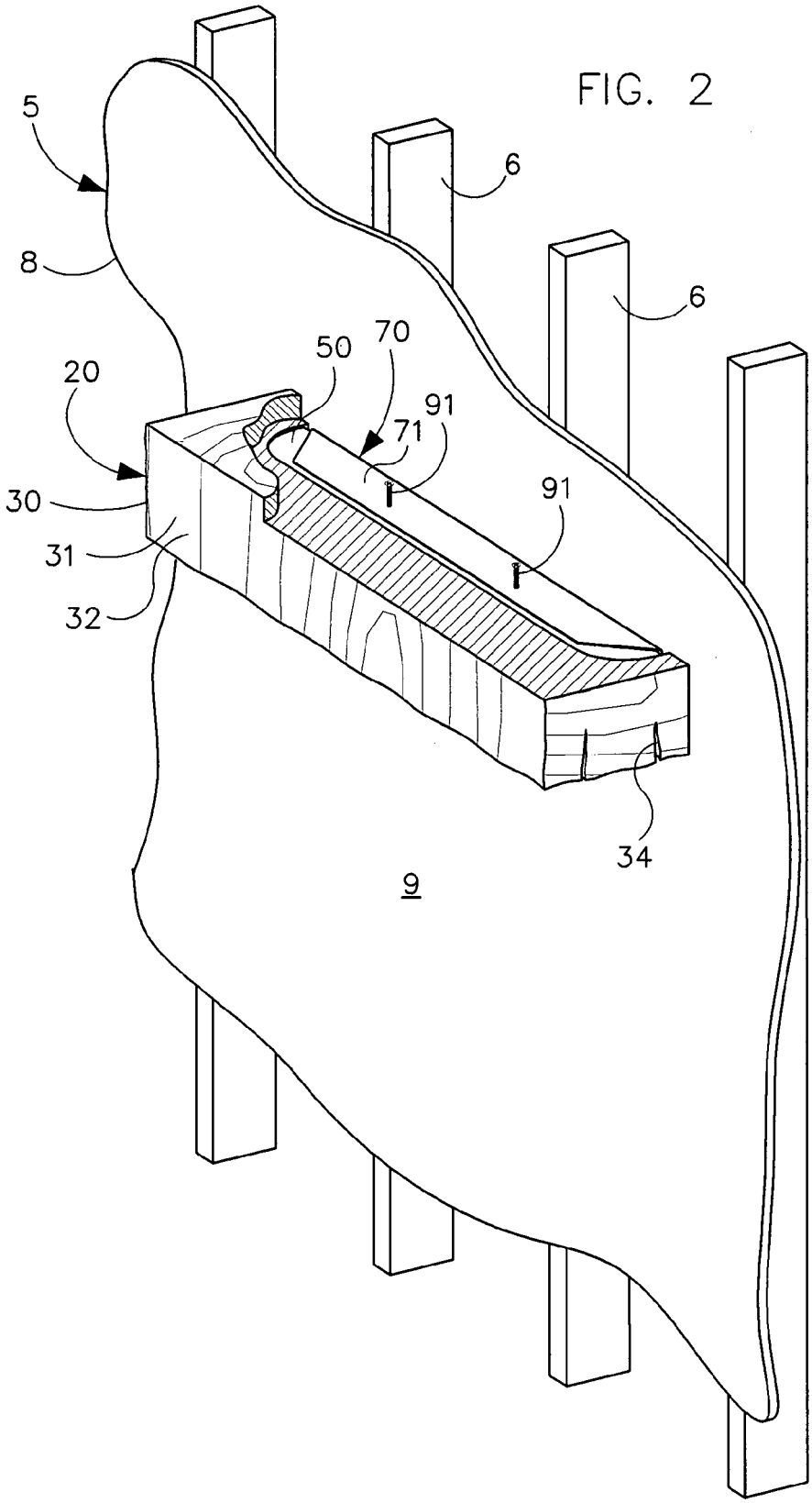
FIG. 2 is the perspective view of FIG. 1 with a portion of the upper layer of the mantel cut away to show the mounting bracket received by its mounting slot and captured by its two mounting fasteners.
Figure 3:
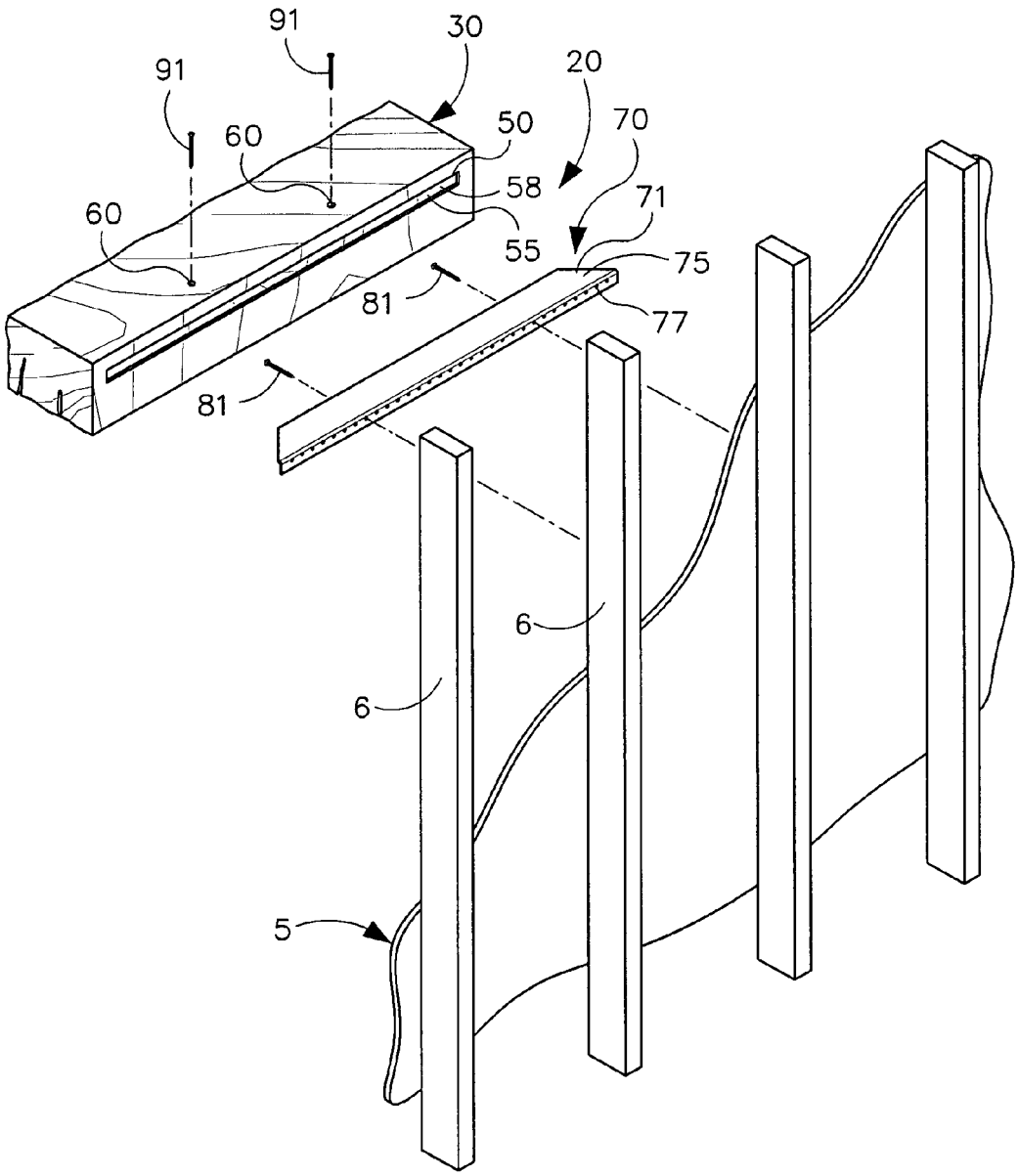
FIG. 3 is an exploded perspective view of the mantel, mounting bracket, two mounting screws and two wall securement screws, with each wall securement screw aligned with one wall stud.

While this invention is susceptible of embodiment in many different forms, the drawings show and the specification describes in detail preferred embodiments of the invention. It should be understood that the drawings and specification are to be considered an exemplification of the principles of the invention. They are not intended to limit the broad aspects of the invention to the embodiments illustrated.

Building walls 5 commonly include a wall frame with uniformly spaced vertical wall studs 6. The wall studs 6 are typically spaced apart about 16 inches. Drywall or another suitable wall forming material 8 is placed over and secured to the wall frame and its studs 6. The outer surfaces 9 of the drywall 8 form the visible surfaces of a room. The wall frame and studs 6 are internal and remain hidden from view. Shelving and mantels are used to elevate items off the floor and display or support them on the vertical wall 5. Shelves and mantels project out from the outer surface 9 of the wall to provide a generally horizontal surface upon which items are placed.

The present invention pertains to a mantel and hidden mounting hardware assembly shown in FIGS. 1-10 and generally designated as reference number 20. The assembly 20 includes a mantel or shelf 30 and its mounting hardware 70. As discussed below, the hardware 70 is hidden from view by persons in the room after the mantel 30 is installed. The mantel or shelf 30 is formed from a block or piece 31 of wood, and preferably a generally solid block of reclaimed wood as in FIGS. 6A-C. Reclaimed wood often has various discontinuities, such as varying grain patterns, knots, splits, cracks or gouges in the wood, and nails or other objects embedded in the wood. The block of wood 31 has a main body 32 with an upper rear layer 33, and top, bottom, front, rear and side surfaces 35-39.

The top surface 35 of the mantel block 31 is typically planed, sanded and varnished to reveal its natural wood texture, and create a flat smooth surface upon which objects can be placed. The block 31 is selected and cut so that the top surface 35 has minimal or no cracks, splits, gouges or embedded nails that would structurally weaken the upper layer 33 or aesthetically impair its top surface 35. The top surface 35 retains its varying grain patterns and knots to give it a natural wood appearance. The front, bottom and side surfaces 36, 37 and 39 are planed flat, deburred and varnished to give them a roughened texture and eliminate potential splintering. These surfaces 36, 37 and 39 retain any natural cracks, splits or gouges in the wood. When possible, the wood block 31 is preferably selected and cut so its natural tree rings are visible at the opposed ends 39 of the block. The rear surface 38 of the block 31 is planed flat and sanded to debur the wood and avoid possible splintering.

The block 31 is shaped to retain certain structural and geometric characteristics. The top 35 and rear 38 surfaces of the block 31 are generally perpendicular or normal. When the mantel or shelf 30 is installed, its top surface 35 forms a generally flat and horizontal surface for placing objects. The top surface 35 projects out from the wall 5, with its rear surface 38 planar to and flushly engaging the vertical wall surface 9. The block 31 can have a wide variety of lengths ranging from about 8 inches to over 92 inches, as illustrated in FIGS. 1-4, 7-8 and 9-10. The block 31 has a preferably uniform rectangular or square cross-sectional shape. The minimum height of the block 31 along its rear surface 38 is about 2 inches. The minimum depth of the block 31 along its top surface 35 is about 4 inches. The block 31 has a height centerline 41.

The cross-sectional or height and depth dimensions of the block 31 can vary widely, provided its height-to-depth ratio is at least about 1 to 3 or ⅓. For example, the block can have a square cross-sectional shape with the both a height and depth of 4 inches, 6 inches, 8 inches, etc., as in FIGS. 1-4 and 9-10, or a rectangular cross-sectional shape with a height of 2 or 3 inches and a longer depth of 6 or 7 inches, respectively, as in FIGS. 7-8. To retain the structural integrity of the block 31, it is selected and cut so that any deep splits or cracks in the reclaimed wood do not extend within 2½ inches of the slot as discussed below. While the front, bottom and side surfaces 36, 37 and 39 of the block 31 are shown and described as being flat and at right angles to their adjacent surfaces to give the mantel a generally block-like appearance, it should be understood by those skilled in the art that these surfaces can be contoured to give the mantel 30 a curved or more decorative shape without departing from the broad aspects of the invention.

An elongated slot 50 is cut into the rear 38 surface of the wood block 31. The slot 50 is deep and narrow in shape relative the block geometry. The slot 50 is spaced from and generally planar to the top surface 35 of the block 31. The slot 50 is located in the upper half of the block 31, and is closer to its top surface 35 than its bottom surface 37. The slot 50 is entirely above the height centerline 41 of the block. The slot 50 forms the upper layer 33 of the block 31 into its main body 32. The slot 50 is preferably cut by a conventional circular saw blade with a radius of about four inches and cut width or thickness of about 3/16 inch. The slot 50 is cut to a uniform depth of about 2½ to 3 inches so that the majority of its inner end 51 is straight and at least about one inch from the front surface 36 of the block 31. The width of the slot 50 is preferably almost as long as the length of the block 31. Each end 52 of the slot 50 terminates about one inch from the corresponding side 39 of the block 31. The ends of the slot 50 are curved and have a radius of the circular saw blade cutting the slot.

An elongated recess 55 is machined into the rear 38 surface of the wood block 31. The recess 55 is shallow relative to the slot 50, and preferably has a uniform depth of about ¼ inch. The top of the recess starts at the lower edge of the slot 50, and extends down the rear surface 38 a predetermined distance of about one inch to its lower end 57. The lower end 57 of the recess 55 is located above the bottom surface 37 of the block 31. The side-to-side width of the recess 55 is generally the same as the slot 50. Each side end 52 of the recess 55 terminates about an inch from its corresponding side 39 of the block 31. The ends of the recess 55 are curved and have a radius equal to that of the dado blades used to form the recess. The slot 50 and recess 55 join to form an L-shaped opening 58 in the rear 38 of the mantel block 31. The slot 50, recess 55 and L-shaped opening 58 are symmetrical about the side-to-side lengthwise centerline or midpoint of the mantel 30. The side-to-side lengths of the slot 50, recess 55 and L-shaped opening 58 are proportional to but less than the length of the mantel 30.

Depending on the length of the mantel 30, one or more mounting or guide holes 60 are machined into the wooden mantel 30. The entry location 62 for each mounting hole 60 is preferably in the top surface 35 of the mantel 30. Each preformed mounting hole 60 extends down from the top surface 35 through the upper rear layer 33 of the block 31 and join with the slot 50. The entry location or top 62 is enlarged by a taper or chamfer to accommodate the head of a mounting fastener as discussed below. The diameter of the mounting or pilot hole 60 is sized to allow a screw fastener to bite or dig into the wooden sides of the hole when it is screwed into guide hole 60. The upper layer 33 of the wooden mantel or shelf 30 above the slot 50 is of sufficient thickness that the metal screw 91 will readily pierce through the enclosed horizontal flange 75 without stripping the wood around the sides 64 of the guide hole 60.

Figure 7:
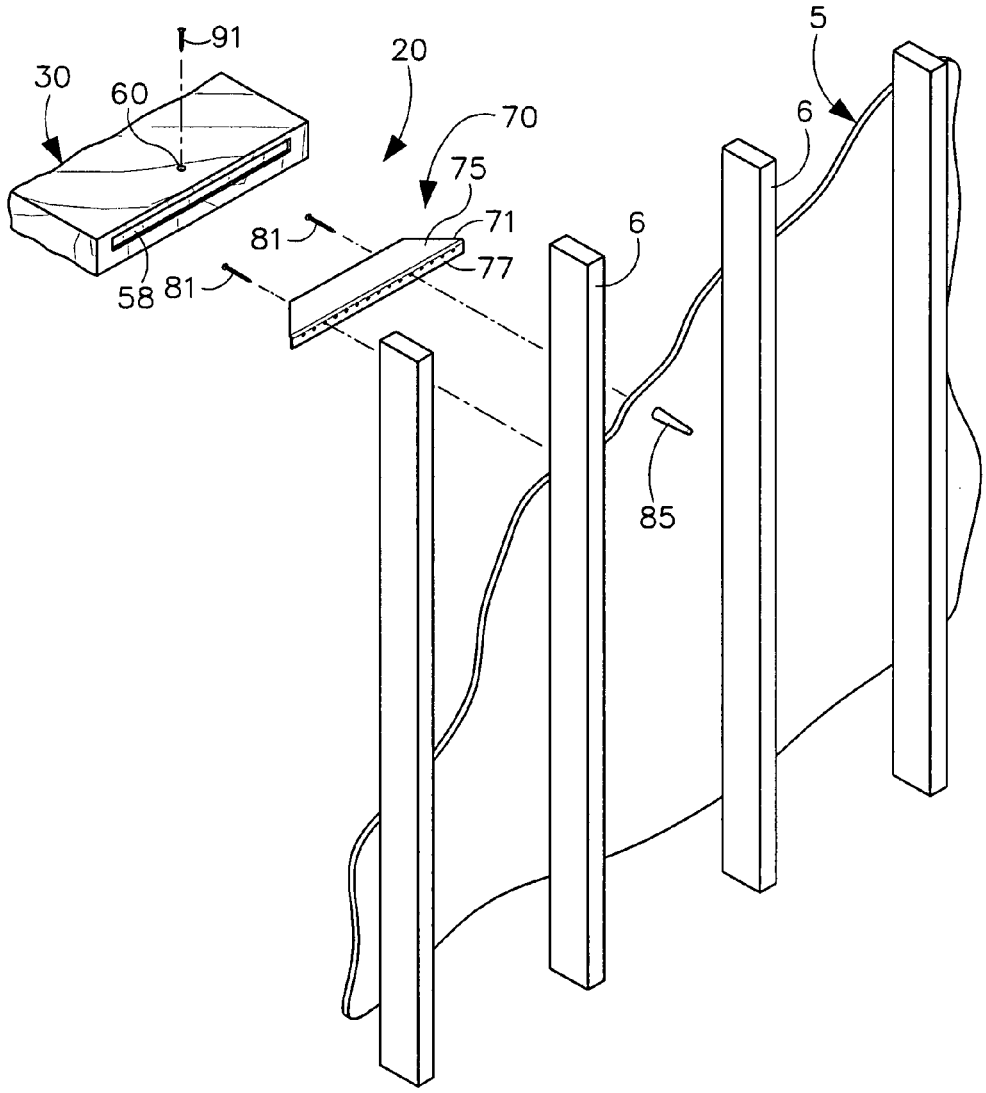
FIG. 7 is an exploded perspective view of a 16 inch long shelf with a 2×6 inch cross-section, one mounting fastener and two wall securement fasteners, where one wall securement fastener is aligned with a wall stud and the other is aligned with a wall anchor.
Figure 9:
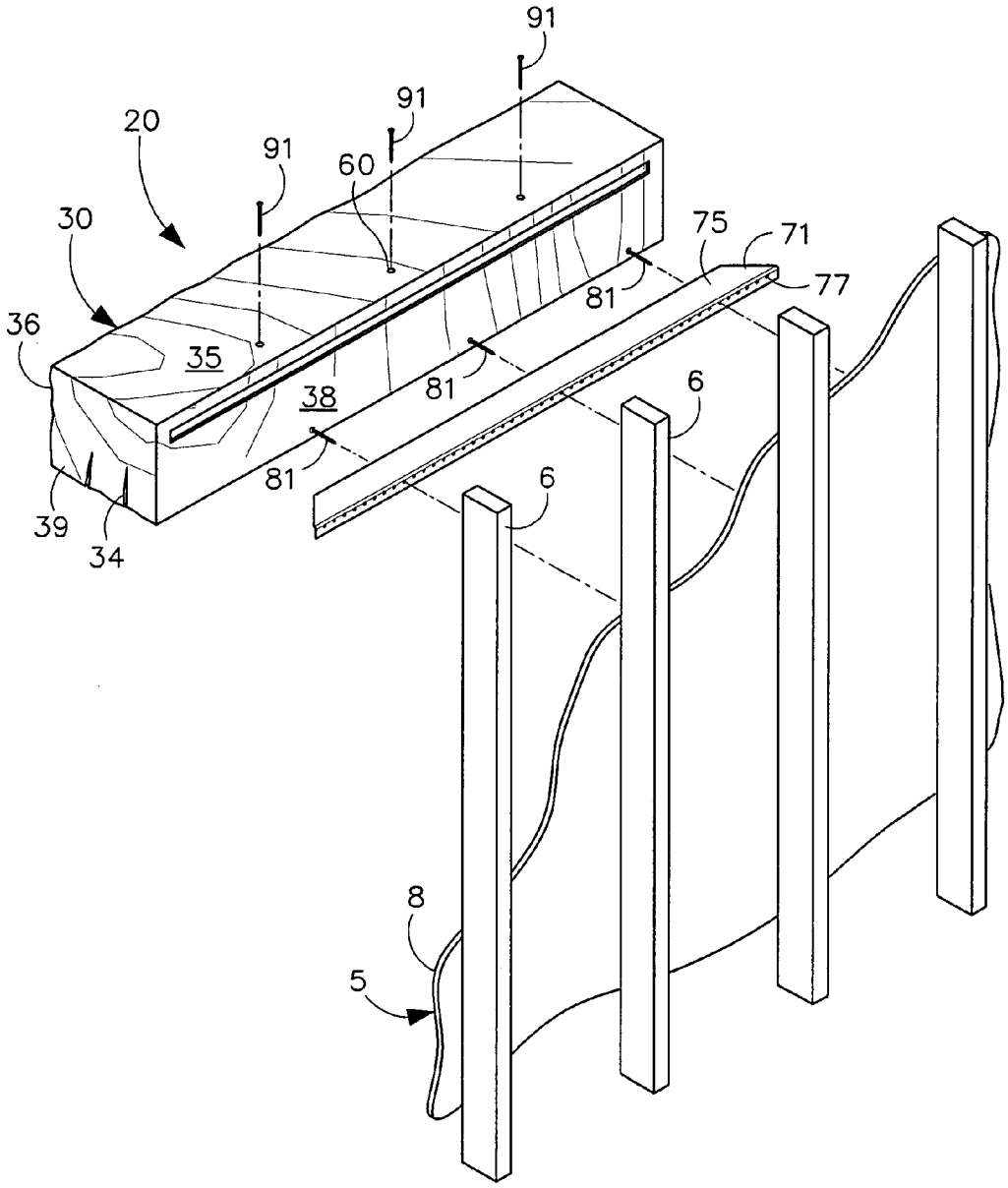
FIG. 9 is an exploded perspective view of a 52 inch long mantel with an 8×8 inch cross-section, three mounting fasteners and three wall securement fasteners, and where each wall securement fastener is aligned with one wall stud.

When the mantel 30 is 24 inches in length or less as in FIGS. 7 and 8A, there is only one mounting hole 60. This single mounting hole 60 is located at or near the lengthwise midpoint of the mantel 30 and its slot 50. When the mantel is 25 to 47 inches in length as in FIGS. 3 and 4A, there are two mounting holes 60 that are uniformly spaced to divide the slot 50 into thirds. When the mantel is 48 to 90 inches in length as in FIGS. 9 and 10A, there are three uniformly spaced mounting holes 60 that divide the slot 50 into fourths, with the center hole located at or near the midpoint of the slot.

A mounting and securement or hardware assembly 70 is used to mount and secure the mantel or shelf 30 to the wall 5 at a desired location. The assembly 70 includes an elongated securement bracket 71 having a length defined by its ends 72 as in FIGS. 5A-C. The bracket 71 length is proportional to but shorter than the slot 50 of the mantel 30. The bracket 71 is generally about two inch shorter than the length of the slot 50, or four inches shorter than the length of the mantel 30. The bracket 71 is preferably made of galvanized steel sheet metal. The sheet metal has a predetermined thickness that provides sufficient strength during use, yet allows a screw to readily pierce the sheet metal during installation by a person using a hand held screwdriver and without stripping the wood sides 64 of the mounting hole 60. The sheet metal has a thickness range of preferably about 0.02 and 0.04 inches, or about 20 and 28 gauge, and more preferably about 0.03 inches, or about 24 gauge.

Figure 5A:
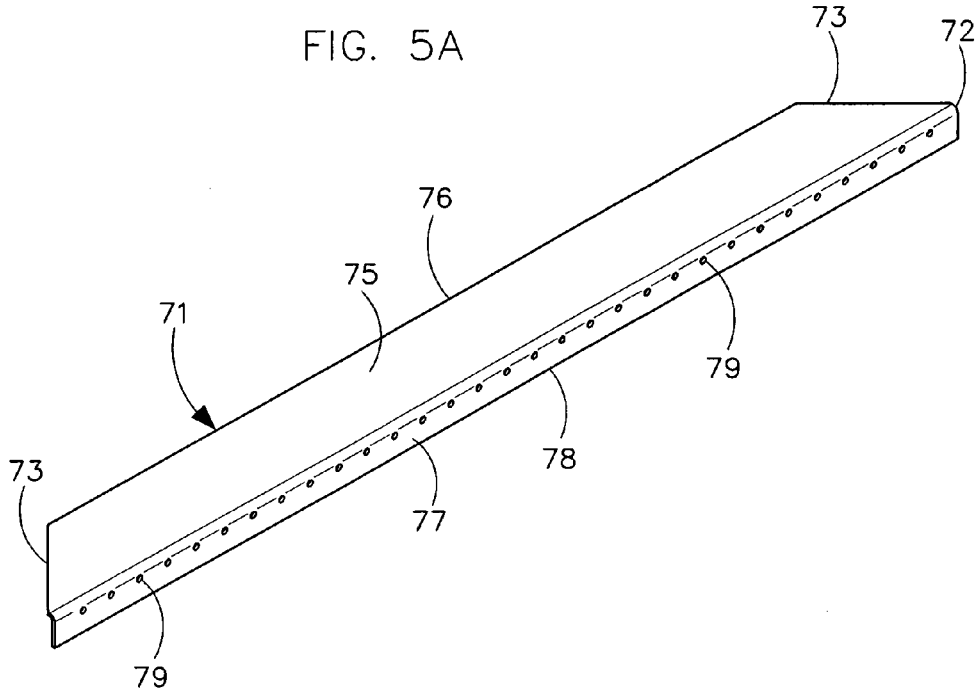
FIG. 5A is a perspective view of the L-shaped mounting bracket and its planar flanges joined at a bend.
Figure 5B:
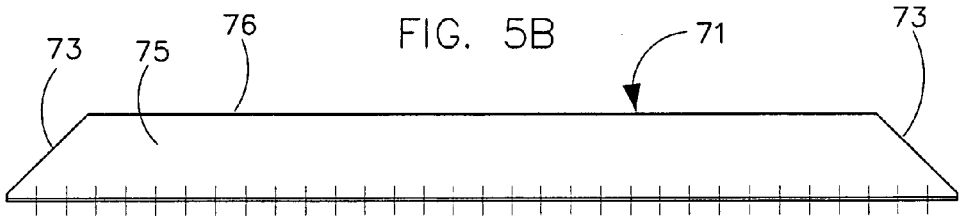
FIG. 5B is a top view of the L-shaped mounting bracket.
Figure 5C:
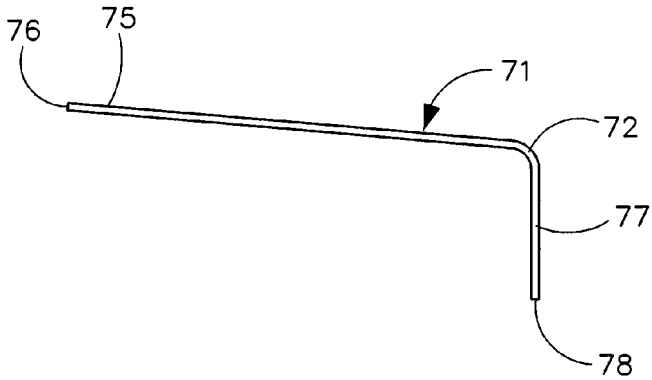
FIG. 5C is a side view of the L-shaped mounting bracket.

The bracket 71 has a generally L-shaped configuration and is sized to allow it to be smoothly received by and mate with the L-shaped mantel opening 58. The sheet metal is bent 73 along its length to form first and second planar flanges 75 and 77. Each flange or leg 75 and 77 is generally flat or planar in shape, and extend the length of the bracket 71. The bend 73 is preferably about 85° prior to installation as shown in FIG. 5C, but is generally 90° after installation with the flanges 75 and 77 being normal or perpendicular to one another. The location of the bend 73 is selected so the first flange 75 is larger than the second flange 77. The outer end 76 of the first flange 75 extends further out from the bend 73 than the outer end 78 of the second flange 77. The first bracket flange 75 extends about two inches from the bend 73 to its end 76, but can increase for mantels 30 with a depth of six or more inches. The second bracket flange 77 extends about one inch from the bend 73 to its end 78. The sides 76 of the first flange 75 are angled to accommodate the curved ends 52 of the slot 50. The second flange 77 includes a plurality of uniformly spaced holes 79 along its length to facilitate its securement to the wall 5 and wall studs 6 via its fastener 81. The holes 79 are preferably one inch apart so that at least one hole 79 is aligned with each vertical stud 6.

The bracket 71 is secured to the wall 5 with two or more securement fasteners 81 such as metal screws with a head and a threaded shank with a tip as in FIGS. 3, 4B, 7, 8B, 9 and 10B. The screw fasteners 81 and bracket holes 79 are located about ¼ to 3/16 inch from the bend 73 to minimize torque loads on the bracket 71 between the bend and fasteners. The screws 81 used in testing are number 8 panhead screws with a high load-strength to head size ratio. The screws 81 are preferably secured to two or more wall studs 6, but some screws can be secured with a wall anchor 85 when necessary. During installation, the back side of the second or vertical bracket flange 77 is placed flush against the vertical surface 9. The first planar flange 75 extends generally horizontally, but with a slight upward tilt, out or away from the wall 5 to form a rigid platform to receive and support all or some of the weight of the mantel 30 during installation.

The bracket 71 is aligned over one or more wall studs depending on the length of the mantel or shelf 30 and the spacing of the wall studs 6. For brackets 71 with a length of eighteen inches or more, two holes 79 in the vertical flange 77 are aligned with two wall studs 6. Securement fasteners 81 are then inserted in their respective hole 79 and screwed or otherwise driven through the drywall 8 and directly into their corresponding wall stud 6. The fasteners 81 are sufficiently long to extend through the drywall material 8 and into its respective stud 6 a sufficient distance to firmly secure or anchor the bracket 71 to the stud.

The number of fasteners 81 used to install the mantel 30 increases with the length of the mantel and its corresponding bracket 71. For bracket 71 with a length less than 18 inches, the bracket is preferably secured to one wall stud 6 and at least one wall anchor 85 as is shown in FIGS. 7 and 8A-C. When the brackets 71 has a length of 18 to 35 inches, the bracket is secured by at least one fastener 81 fixed to a wall stud 6, and preferably two fasteners 81 fixed to two adjacent wall studs 6 as shown in FIGS. 3 and 4A-C. For brackets 71 with a length of 36 to 53 inches, the bracket is secured by at least two fasteners 81 fixed to two adjacent wall studs 6, and preferably three fasteners 81 fixed to three adjacent wall studs 6 as shown in FIGS. 9 and 10A-C. For brackets 71 with a length of 54 to 71 inches, the bracket is secured by at least three fasteners fixed to three adjacent wall studs 6, and preferably four fasteners 81 fixed to four adjacent wall studs 6. For brackets 71 with a length of 72 to 90 inches, the bracket is secured by at least four fasteners 81 fixed to four fixed to four adjacent wall studs 6 and preferably five fasteners 81 fixed to five adjacent wall studs 6.

Once the bracket 71 is firmly secured to the wall 5 and its studs 6, the mantel or shelf 30 is installed over the bracket. The mantel 30 is held or placed in front of the bracket 71 with its rear surface 38 facing the wall 5. The mantel slot 50 is in planar alignment with first or generally horizontal bracket flange 75, and the ends 72 of the bracket 71 are in left-to-right registry with the slot. The mantel 30 is then pushed or slid onto the bracket 71 so that the flange 75 enters and is received and captured by the slot 50 as best shown in FIGS. 2, 4B, 8B and 10B. The mantel 50 is pushed back until the now horizontal flange 75 is entirely received and enclosed by the slot 50, and the recess 55 receives the vertical flange 77 and the heads of the wall securement screws 81. The L-shaped bracket 71 is fully received by and mated with the L-shaped mantel opening 58. The rear surface 38 of the mantel 30 flushly engages and is pressed against the surface 9 of the wall 6.

Figure 10A:
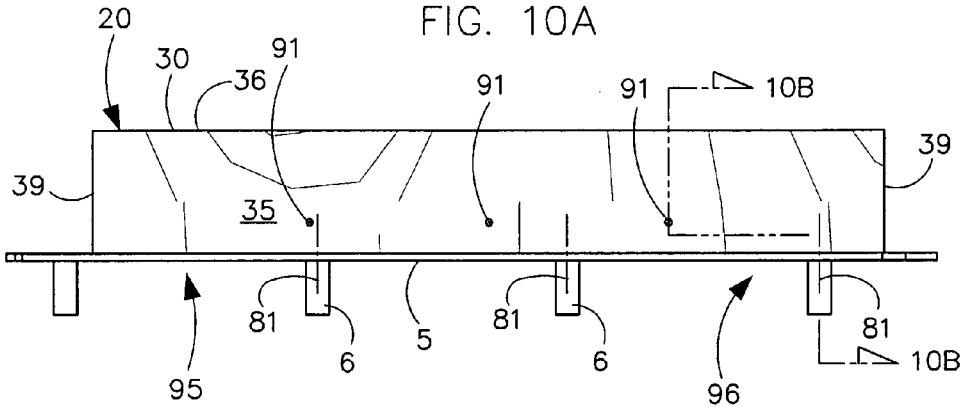
FIG. 10A is a top view of the 52 inch long mantel secured to the wall via three wall studs, and showing the offset alignment of the wall securement and mantel mounting screws and also showing the mantel offset to the left from the three wall studs to which it is secured.
Figure 10B:
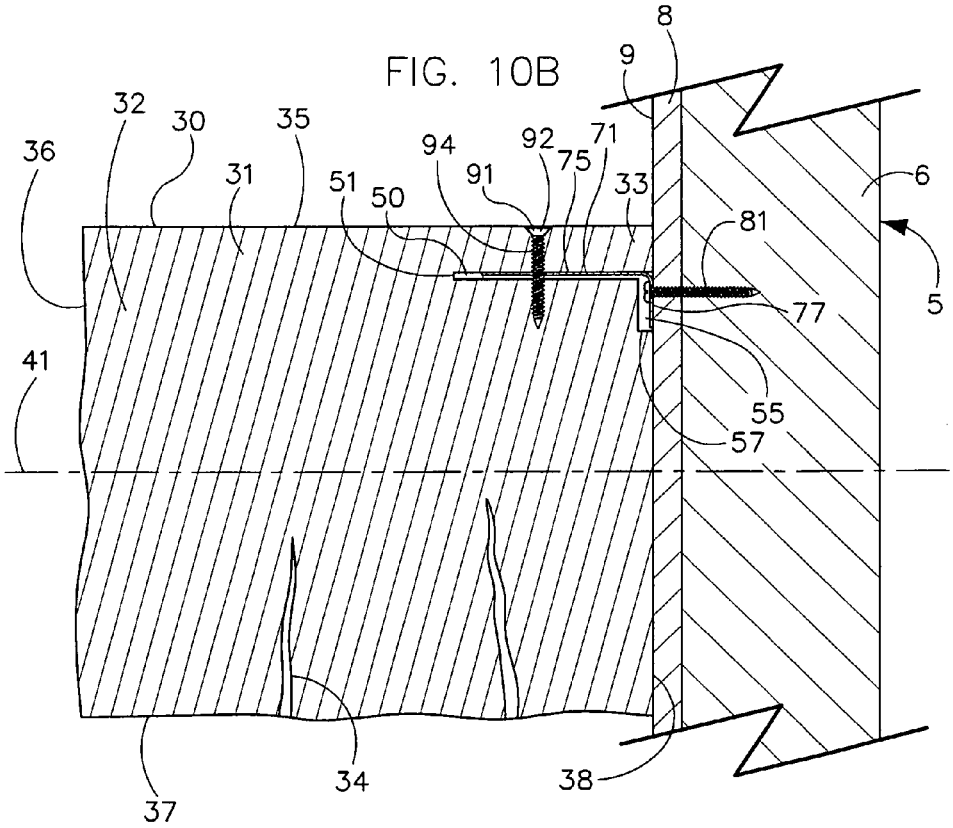
FIG. 10B is a cross sectional view of FIG. 10A taken along line 10B-8B showing the 8×8 inch height and depth of the mantel with its L-shaped mounting bracket received by its L-shaped slot and recess opening with its mounting screw passing through the captured horizontal bracket flange, and one of the securement screws fixing the vertical flange to a wall stud.

One or more mounting fasteners 91 are then used to firmly secure and supportably hold the mantel or shelf 30 to the wall 5 as best shown in FIGS. 4B, 8B and 10B. The number of mounting holes 60 and fasteners 91 depend on the length of the mantel 30 and its slot 50. As discussed above, one centrally located mounting hole 60 and fastener 91 is used for mantels of 12 to 23 inches as in FIG. 3. Two uniformly spaced mounting holes 60 and fasteners 91 are used for mantels of 24 to 47 inches as in FIG. 7. Three uniformly spaced mounting holes 60 and fasteners 91 are used for mantels of 48 to 92 inches as in FIG. 9. The screws 91 used in testing are number 8 countersunk screws. Additional mounting holes 60 and fasteners 91 are added for longer mantels. The location of the mounting holes 60 can be adjusted to avoid any discontinuities such as knotholes in or near the upper layer 33 of the mantel 30.

A mounting fastener or screw 91 is linearly aligned with and initially inserted into the entry location 62 of one of the mounting holes 60 on the top 35 of the mantel. This can be done in advance or after the bracket 71 is inserted into the slot 50 and recess 55 of the mantel 30. Each fastener 91 has a length of about 1¼ to 1⅝ inches, and includes a head 92 and shank 94 with a tip. The fasteners 91 are preferably screws with threaded shanks 94. The diameter of the shank 94 is smaller than the guide hole 60 so that its threads will bite or dig into the wooden sidewalls 64 of the mounting hole 60. The screw fastener 91 is screwed or otherwise guidably driven into and through the guide hole 60 in the upper layer 33 of the mantel 30 until its tip enters the slot 50. The screw 91 is firmly held longitudinally by its threaded engagement with the upper layer 33.

With the mantel placed or pressed against the wall 5, the fastener is driven through the captured flange 75. Continued rotation of the screw 91 causes it to extend down into forced engagement with the flange 75 until it pierces the flange 75 and begins to enter the main body 32 of the block 31 below the slot 50. This piecing of the captured flange 75 secures the mantel 30 to the bracket 71 and the wall 5. Each mounting fastener 91 is sufficiently long to allow its shank 94 to further extend into the main body 32 of the block 31 below the slot 50.

The screw fastener 91 is held in place both above and below the flange 75 by the upper layer 33 and main body 32 of the block 31, respectively. The threads bite or dig into the wooden sidewalls 64 of the mounting hole 60 above the slot 50 and the main body 32 of the block 31 below the slot. The fastener 91 firmly grips the wood on both sides of the captured flange 75 to secure the mantel 30 to the bracket 71 and flushly hold its rear surface 38 against the wall 5. The head of the screw or fastener 91 is received by the tapered entry location 62 which also forms a stop for the insertion of the screw. When the mantel 30 has more than one mounting hole 60 and screw fastener 91, the additional fasteners are then inserted into their respective mounting hole 60 and screwed or otherwise guidably driven through that mounting hole until it pierces the flange 75 and passes into the main body 32 of the block 31 below the slot 50.

The lower surface of the upper layer 33 of the block 31 rests on and is supported by the top surface of the horizontal bracket flange 75 as best shown in FIGS. 4B, 8B and 10B. The main body 32 of the mantel block 31 below the slot 50 is supported by the front 36 and side 39 perimeter of the block 31 as the slot does not extend into these portions of the block. The main body 31 of the block 31 below the slot 50 is further supported by the screw fasteners 91 that bite into the wood both above and below the slot 50. The uniformly spaced mounting holes 60 and fasteners 91 along the length of the slot 50, help support the weight of the main body 32 of the block 31 below the slot 50.

Selective lateral positioning of the mantel 30 relative to the wall studs 6 is possible as best shown in FIGS. 4A, 8A and 10A. The flexibility in selecting the lateral position of the mantel 30 on a wall 5 is possible because the mantel and its bracket 71 can have an offset alignment 95 with the wall studs 6. This flexibility is also possible because the pre-drilled mantel mounting holes 60 and fasteners 91 that are uniformly spaced across the length of the slot 50 can have an offset alignment 96 with the wall fasteners 81 and studs 6. Thus, the mantel 30 can be located at a desired location on a wall 5 (e.g., the center of the wall 5), and does not need to be centered with the wall studs 6.

While the predrilled mounting hole 60 is shown and described as having its entry location 62 in the top surface 35 of the mantel 30, it should be understood that in an alternate embodiment the entry location can be in the bottom surface of the mantel with the mounting hole extend up to the slot 50, or even angled from the front or side surfaces 36 or 39 of the mantel, provided the mounting hole is accessible when the rear surface of the mantel is pressed against the wall 5. In addition, while the mounting hole 60 is shown and described as engaging the slot 50, it should be understood that when the mounting fastener 91 is a screw, the mounting hole could be shorter or longer provided it guides the fastener 91 into piercing engagement with the captured bracket flange 75. Further, while the mounting hole 60 is shown and described as ending at the slot 50, it should be understood that in an alternate embodiment where the mounting fastener has no tip, such as a peg, the mantel mounting hole can extend down below the slot and into the main body 32 of the mantel 30 below the slot. In this situation, a hole is also formed in the flange 75 at the desired mounting location via some other tool or mechanism such as a punch or drill press.

Method of Installation

Figure 11:
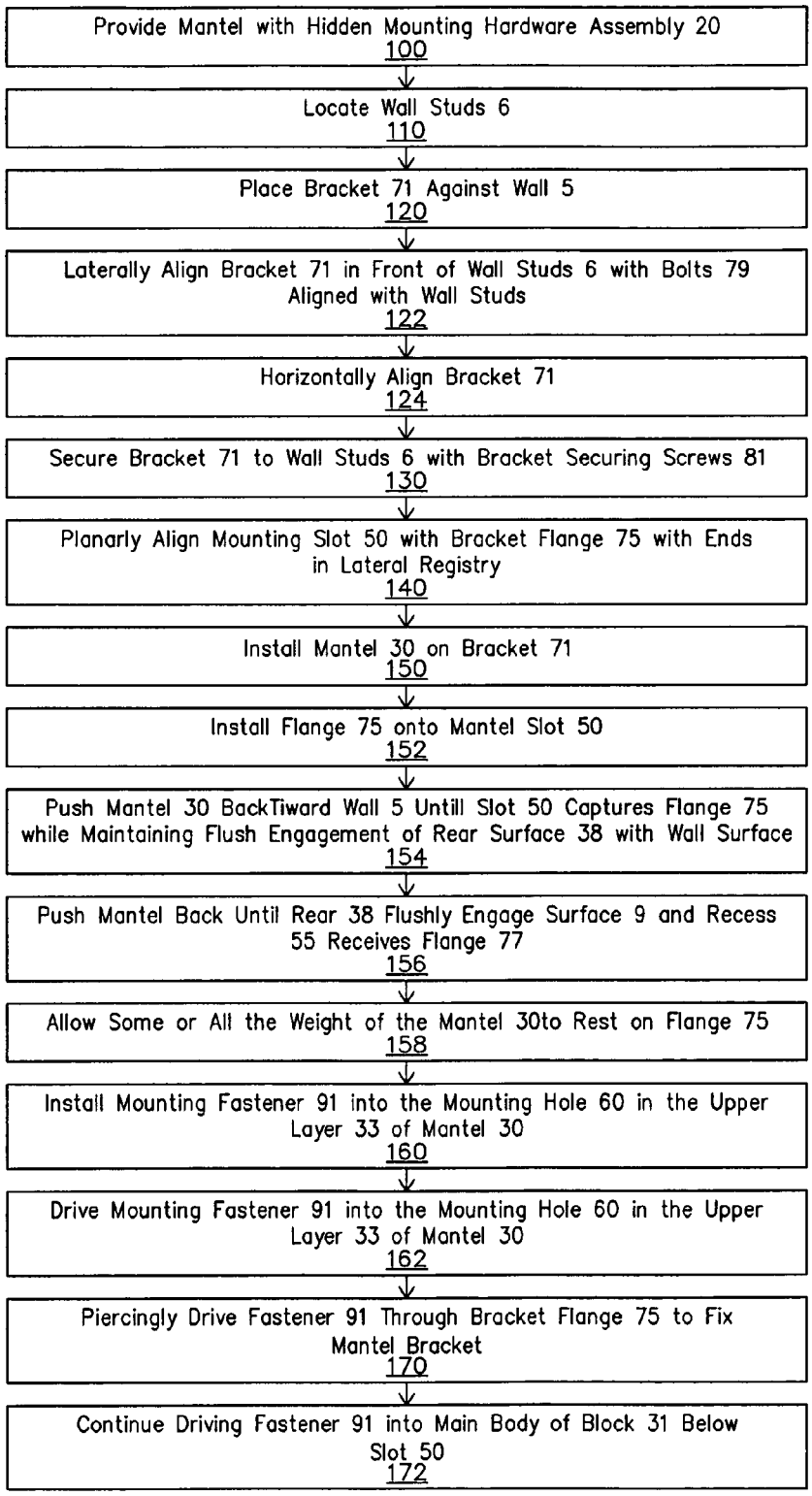
FIG. 11 is a flow chart showing the steps for installing the mantel with hidden hardware assembly.

While the method of installing the mantel and hidden hardware assembly should be apparent given the above description, the following is provided to more fully explain the method of installation to the reader. As shown in FIG. 11, the first step 100 is to provide the mantel and hardware assembly 20. The second step 110 is to locate the wall studs 6 for securing the mantel 30. The bracket 71 is then placed 120 against wall 5 with flange 77 flush against wall surface 9 with flange 75 extending out from wall above flange 77. The mounting bracket 71 is then laterally aligned 122 or positioned in front of two or more wall studs 6, and horizontally aligned 124 on the wall 5 with flange 75 extending horizontally. One of the holes 79 in the vertical flange 77 should be aligned with each wall stud 6. Next, the vertical flange 77 is secured 130 to the wall 5 with the wall securing fasteners or screws 81. Preferably all the screws 81, but at least one, are directly secured to a wall stud 6. Any bracket screw 81 not secured to a wall stud 6 is secured to the drywall or wall surface material 8 via a conventional wall anchor 85.

With the bracket 71 secured to the wall 5, the mantel or shelf 30 is ready for mounting. The mantel 30 is elevated to the height of the bracket 71. The mantel slot 50 is then brought into planar alignment 140 with the planar horizontal flange 75 with its ends 73 in lateral registry with slot ends 56. The mantel 30 is then installed 150 on the bracket 71. During this installation 150, the flange 75 is inserted 152 into the mantel slot 50, and the mantel 30 is slide or pushed 154 back until the flange 75 is captured by the slot 50 and the rear mantel surface 38 flushly engages 156 the wall surface 9, and allowing 158 some or all of the weight of the mantel 30 to rest on the now horizontal flange 75 so that it acts as a platform to support the mantel 30. The vertical flange 77 and heads of the bracket fasteners 81 are received by the rear recess 55 of the mantel 30.

The mantel mounting fastener 91 is then installed 160 to secure the mantel 30 to the bracket 71. The fastener 91 is linearly aligned with and inserted 162 into entrance location 62 of mounting hole 60, and driven 162 into the mounting hole 60 in upper layer 33 of mantel 30 until the fastener is just short of entering slot 50. It should be understood that the insertion 160 and initial driving 162 of the mantel mounting fastener 91 can be done prior to or after the alignment and installation 140 and 150 of the mantel on the bracket 71. Then, while continuing to allow some of the weight of the mantel 30 to rest on the bracket flange 75 and maintaining the flush engagement of the mantel rear surface 38 with the wall surface 9, the mounting fastener 91 is piercingly driven 170 down into the top of the flange 75 so that the fastener passes completely through and captures the flange 75 in the slot 50. Then, continue driving 172 the screw fastener 91 down into the main body 32 of the mantel 30 below the slot 50 to anchor the screw on both sides of the slot and fix the mantel to the bracket 71 The mantel 30 is now secured to the wall 5 with its mounting hardware hidden from view.

While the invention has been described with reference to preferred embodiments, it will be understood by those skilled in the art that various changes may be made and equivalents may be substituted without departing from the broader aspects of the invention. For example, multiple brackets can be used for longer mantel installations. Each bracket can be less than half the mantel block length and multiple linear slots can be formed in the block to receive those brockets. In addition, the mounting bracket can be formed from sheets of sufficiently strong and pierceable materials other than sheet metal, or by multiple overlapping sheets of material to achieve a desired gauge thickness.

I claim:

1. A wooden mantel with hidden mounting hardware for a wall having an outer surface and at least two spaced vertical wall studs, said wooden mantel with hidden mounting hardware comprising:

a mantel made of a block of wood having top, bottom, front, rear and end surfaces, a block length of at least about 12 inches, a block height of at least about 2 inches, a block depth of at least about 4 inches, a block height centerline and a block height-to-depth ratio of at least about 1 to 3, said top and rear surfaces being substantially normal, said rear surface having an elongated mounting slot above said block height centerline, said slot extending into said block to a slot depth of at least about 2 inches and terminating short of said front and end surfaces, said slot forming an upper layer of said block, and said block having at least one mantel mounting hole with an entry location on one of said block surfaces, each said mounting hole extending from its said entry location through said block to said slot, and said rear surface having an elongated rear recess extending from said slot toward said bottom surface and terminating short of said bottom and end surfaces;

an elongated mounting bracket with elongated first and second bracket flanges, said first bracket flange forming a platform sized for insertion into said elongated slot, and said second bracket flange adapted to flushly engage the outer surface of the wall and sized for receipt by said elongated recess, said elongated mounting bracket allowing selective lateral positioning of said mantel on the wall;

at least two bracket securing fasteners, each securing said second bracket flange to one of the at least two spaced vertical wall studs; and, at least one mantel mounting fastener sized for secure threaded reception in said mounting hole, said mounting fastener piercing said first bracket flange and threadably extending further into said block to fix said first bracket flange inside said slot and secure said mantel to said mounting bracket with said rear surface of said mantel adapted for flush engagement with the outer surface of the wall.

2. The wooden mantel with hidden mounting hardware of claim 1, and wherein said mounting bracket is formed from sheet metal having a thickness of between 20 and 28 gauge, and said at least one mounting fastener is a screw with a tip to pierce said sheet metal.

3. The wooden mantel with hidden mounting hardware of claim 2, and wherein said sheet metal bracket is formed from 24 gauge sheet metal.

4. The wooden mantel with hidden mounting hardware of claim 2, and wherein said slot is substantially planar to said top surface of said mantel, and said at least one mounting hole is at least about 1 inch from said rear surface of said mantel block.

5. The wooden mantel with hidden mounting hardware of claim 4, and wherein said mounting hole entry location is in said top surface of said mantel and said mounting hole extends through said upper layer to said slot.

6. The wooden mantel with hidden mounting hardware of claim 5, and wherein said mounting hole is selectively offset from each of said bracket securing fasteners and their corresponding wall studs to allow said selective lateral positioning of the bracket on the wall.

7. The wooden mantel with hidden mounting hardware of claim 5, and wherein said block height is about 2 to 3 inches and said upper layer is at least about ½ inch thick.

8. The wooden mantel with hidden mounting hardware of claim 5, and wherein said block height is about 3 to 4 inches and said upper layer is about ⅝ inch thick.

9. The wooden mantel with hidden mounting hardware of claim 5, and wherein said block height is greater than at least about 4 inches and said upper layer is ¾ to 1 inch thick.

10. The wooden mantel with hidden mounting hardware of claim 2, and wherein said sheet metal bracket is L-shaped with a bend, said first and second bracket flanges being planar and extending substantially perpendicularly from said bend when installed.

11. The wooden mantel with hidden mounting hardware of claim 2, and wherein said slot has a height of about 3/16 inch and a slot depth of at least about 3 inches.

12. The wooden mantel with hidden mounting hardware of claim 1, and wherein said block of wood is reclaimed wood with naturally occurring splits and knots that form discontinuities in the wood, and said upper layer is free from any of said splits.

13. The wooden mantel with hidden mounting hardware of claim 1, and wherein each of said at least one mantel mounting fasteners is weight bearingly secured to said upper layer and a main body of said block below said slot, said at least one mantel mounting fasteners weight bearingly supporting said main body of said block below said slot.

14. The wooden mantel with hidden mounting hardware of claim 13, and wherein said at least one mounting hole is at least two mounting holes spaced uniformly along said slot.

15. The wooden mantel with hidden mounting hardware of claim 1, and wherein said second flange has a plurality of uniformly spaced, linearly aligned preformed holes along its length, and wherein each of said bracket securing fasteners passes through one of said preformed holes.

16. The wooden mantel with hidden mounting hardware of claim 1, and wherein said mantel is at least about 25 inches long, said elongated slot is at least about 23 inches long and said elongated bracket is at least about 21 inches long, and there are at least two mounting holes and two mounting fasteners.

17. The wooden mantel with hidden mounting hardware of claim 1, and wherein said mantel is at least about 48 inches long, said elongated slot is at least about 46 inches long and said bracket length is at least about 44 inches, and there are at least three mounting holes and three mounting fasteners.

18. A wooden mantel with hidden mounting hardware for a wall having an outer surface and at least two spaced internal vertical wall studs, said wooden mantel with hidden mounting hardware comprising:

a mantel made of a block of wood having top, bottom, front, rear and end surfaces, a block length of at least about 12 inches, a block height of at least about 2 inches, a block depth of at least about 4 inches, a block height centerline and a block height-to-depth ratio of at least about 1 to 3, said top and rear surfaces being substantially normal, said rear surface having an elongated mounting slot above said block height centerline, said slot extending into said block to a slot depth of at least about 2 inches and terminating short of said front and end surfaces, said slot forming an upper layer of said block, and said block having at least one mantel mounting hole with an entry location on one of said block surfaces, each said mounting hole extending from said entry location through said block to said slot, and said rear surface having an elongated rear recess extending from said slot toward said bottom surface and terminating short of said bottom and end surfaces;

an elongated mounting bracket with elongated first and second bracket flanges, said first bracket flange forming a platform sized for insertion into said elongated slot, and said second bracket flange adapted to flushly engage the outer surface of the wall and sized for receipt by said elongated recess, said elongated mounting bracket allowing selective lateral positioning of said mantel on the wall;

at least two bracket securing fasteners, one of said bracket securing fasteners securing said second bracket flange to at least one of the spaced internal vertical wall studs, and another of said bracket securing fasteners securing said second bracket flange to one of either another of said spaced internal vertical wall studs and a wall anchor; and, at least one mantel mounting fastener adapted for secure threaded reception in said mounting hole, said mounting fastener piercing said first bracket flange and threadably extending further into said block to fix said first bracket flange inside said slot and secure said mantel to said mounting bracket with said rear surface of said mantel engaging the outer surface of the wall.

19. A method for mounting a wooden mantel to a wall having an outer surface and spaced internal vertical wall studs, said method of mounting a mantel comprising:

providing a mantel made of a block of wood having top, bottom, front, rear and end surfaces, a block length of at least about 12 inches, a block height of at least about 2 inches, a block depth of at least about 4 inches, a block height centerline and a block height-to-depth ratio of at least about 1 to 3, said top and rear surfaces being substantially normal, said rear surface having a deep mounting slot above said block height centerline, said slot extending into said block to a slot depth of at least about 2 inches, said slot terminating short of said front and each of said end surfaces, said slot forming an upper layer from a main body of said block, and said block having at least one mounting hole extending through said block to said slot, and said rear surface having a shallow rear recess extending from said slot toward said bottom surface and terminating short of said bottom and end surfaces, a mounting bracket having first and second flanges, at least two bracket securing fasteners, and at least one mantel mounting fastener;

locating the at least two wall studs;

placing said elongated bracket against the wall surface with said first flange extending out from the wall above said second flange;

aligning said first flange generally horizontally on the outer surface of the wall with said bracket positioned in front of at least one of the at least two wall studs;

securing said bracket to the wall with said at least two bracket securing fasteners, at least one of said bracket securing fattener extending into the at least one wall stud;

aligning said mantel with said bracket, said elongated slot being in planar alignment and longitudinal registry with said first flange;

installing said mantel on said bracket, said first flange being received by said slot;

pushing said mantel back on said bracket until said rear surface of said mantel flushly engages the outer surface of the wall;

driving said at least one mounting fastener into said at least one mounting hole until said mounting fastener engages said first flange; and, piercingly drive said at least one mounting fastener through said first flange to capture said first flange in said slot and fix said mantel to said bracket and secure said mantel to the wall.

20. The method for mounting a mantel to a wall of claim 19, and further comprising the step of continuing to drive said at least one mounting fastener into said main body of said mantel after said piercing step, said mounting fastener being rigidly held by said mantel on both sides of said slot.

21. The method for mounting a mantel to a wall of claim 19, and wherein said mantel has weight and further comprising the step of allowing said weight of said mantel to rest on said first flange before said piercing step.

* * * * *